US007923655B2

(12) United States Patent
Quine et al.

(10) Patent No.: US 7,923,655 B2
(45) Date of Patent: Apr. 12, 2011

(54) SORTING METHOD AND SYSTEM WITH DYNAMICALLY RE-ALLOCATED SORTATION BINS

(75) Inventors: Douglas B. Quine, Bethel, CT (US); Christopher A. Baker, New Canaan, CT (US)

(73) Assignee: Pitney Bowes Inc., Stamford, CT (US)

( * ) Notice: Subject to any disclaimer, the term of this patent is extended or adjusted under 35 U.S.C. 154(b) by 1731 days.

(21) Appl. No.: 10/980,584

(22) Filed: Nov. 3, 2004

(65) Prior Publication Data

US 2006/0113223 A1 Jun. 1, 2006

(51) Int. Cl.
*B07C 5/00* (2006.01)

(52) U.S. Cl. ..... 209/584; 209/900; 700/223; 700/224; 700/226

(58) Field of Classification Search ..... 209/584, 209/900; 700/223, 224, 226
See application file for complete search history.

(56) References Cited

U.S. PATENT DOCUMENTS

| | | | | |
|---|---|---|---|---|
| 5,328,169 | A * | 7/1994 | Mandel | 271/290 |
| 5,518,122 | A * | 5/1996 | Tilles et al. | 209/539 |
| 5,810,173 | A * | 9/1998 | Stevens et al. | 209/539 |
| 5,901,855 | A * | 5/1999 | Uno et al. | 209/584 |
| 6,107,589 | A * | 8/2000 | Yamashita et al. | 209/584 |
| 6,279,750 | B1 * | 8/2001 | Lohmann | 209/559 |
| 6,283,304 | B1 * | 9/2001 | Gottlieb et al. | 209/603 |
| 6,455,797 | B1 * | 9/2002 | Grund | 209/583 |
| 6,881,916 | B2 * | 4/2005 | McLaughlin et al. | 209/584 |
| 6,892,890 | B2 * | 5/2005 | Dominguez | 209/559 |
| 7,060,928 | B2 * | 6/2006 | Jirsa | 209/584 |
| 2002/0104782 | A1 * | 8/2002 | DeWitt et al. | 209/3.3 |
| 2004/0251180 | A1 * | 12/2004 | McDonald | 209/584 |
| 2006/0070929 | A1 * | 4/2006 | Fry et al. | 209/583 |

FOREIGN PATENT DOCUMENTS

| | | | |
|---|---|---|---|
| DE | 19528803 | C | 1/1997 |
| EP | 0718049 | A | 6/1996 |
| EP | 1084770 | A | 3/2001 |
| WO | 2004/111800 | A | 12/2004 |

* cited by examiner

*Primary Examiner* — Joseph C Rodriguez
(74) *Attorney, Agent, or Firm* — Brian A. Collins; Steven J. Shapiro; Charles R. Malandra, Jr.

(57) ABSTRACT

A sorter system includes a plurality of sortation bins with a feed path connected to the plurality of sortation bins for transporting media items to destination sortation bins. A controller is connected to control the plurality of sortation bins and is operable during a sortation process to reassign the destination sortation bin into which a media item is sorted. The system operation may employ a method for sorting media items where a plurality of media items are fed onto a transport system for sortation. Each media items is sorted into a destination sortation bin of a plurality of sortation bins connected to said transport system. Destination sortation bins for media items are dynamically reassigned based of the determined status of the media items in the sortation bins. The status of media items is sensed in each of said plurality of sortation bins may be determined based on sensors associated with the equipment or tracked by a controller or other techniques which track the mail pieces being processed. Destination sortation bins may be assigned to accommodate overflow capacity from existing bins thereby creating larger effective bins. They may also be assigned to allow the reuse of existing bins thereby creating a sortation system with a greater effective number of sortation bins.

7 Claims, 7 Drawing Sheets

| | OVERFLOW SORTATION BIN 303 | | | | ORIGINAL SORTATION BIN 301 | | |
|---|---|---|---|---|---|---|---|
| MACHINE BIN STATUS | BIN CONDITION | EMPTY | FULL | | BIN CONDITION | EMPTY | FULL |
| 0 | SOME | 0 | 0 | | SOME | 0 | 0 |
| 1 | SOME | 0 | 0 | | FULL | 0 | 1 |
| 2 | SOME | 0 | 0 | | EMPTY | 1 | 0 |
| 3 | SOME | 0 | 0 | | ERROR | 1 | 1 |
| 4 | FULL | 0 | 1 | | SOME | 0 | 0 |
| 5 | FULL | 0 | 1 | | FULL | 0 | 1 |
| 6 | FULL | 0 | 1 | | EMPTY | 1 | 0 |
| 7 | FULL | 0 | 1 | | ERROR | 1 | 1 |
| 8 | EMPTY | 1 | 0 | | SOME | 0 | 0 |
| 9 | EMPTY | 1 | 0 | | FULL | 0 | 1 |
| 10 | EMPTY | 1 | 0 | | EMPTY | 1 | 0 |
| 11 | EMPTY | 1 | 0 | | ERROR | 1 | 1 |
| 12 | ERROR | 1 | 1 | | SOME | 0 | 0 |
| 13 | ERROR | 1 | 1 | | FULL | 0 | 1 |
| 14 | ERROR | 1 | 1 | | EMPTY | 1 | 0 |
| 15 | ERROR | 1 | 1 | | ERROR | 1 | 1 |

FIG.3

| OPERATIONAL CONDITION | | OVERFLOW SORTATION BIN 303 | | | | ORIGINAL SORTATION BIN 301 | | |
|---|---|---|---|---|---|---|---|---|
| | MACHINE BIN STATUS | BIN CONDITION | EMPTY | FULL | | BIN CONDITION | EMPTY | FULL |
| SORTATION START | 10 | EMPTY | 1 | 0 | | EMPTY | 1 | 0 |
| ORIGINAL IN USE | 8 | EMPTY | 1 | 0 | | SOME | 0 | 0 |
| ORIGINAL FULL, ASSIGN OVERFLOW | 9 | EMPTY | 1 | 0 | | FULL | 0 | 1 |
| ORIGINAL FULL, OVERFLOW COVERING | 1 | SOME | 0 | 0 | | FULL | 0 | 1 |
| ONE IN USE, OTHER BEING EMPTIED | 0 | SOME | 0 | 0 | | SOME | 0 | 0 |
| OVERFLOW IN USE; ORIGINAL AVAILABLE | 2 | SOME | 0 | 0 | | EMPTY | 1 | 0 |
| ALL FULL, STOP | 5 | FULL | 0 | 1 | | FULL | 0 | 1 |
| OVERFLOW FULL; ASSIGN ORIGINAL | 6 | FULL | 0 | 1 | | EMPTY | 1 | 0 |
| OVERFLOW FULL, ORIGINAL FILLING | 4 | FULL | 0 | 1 | | SOME | 0 | 0 |

FIG. 4

| | PERMANENT ASSIGNMENT | SET B DYNAMIC ASSIGNMENT | SET C DYNAMIC ASSIGNMENT |
|---|---|---|---|
| FIRST SORTATION BIN ASSIGNMENT: | 06484 | 01451 | 02108 |
| SECOND SORTATION BIN ASSIGNMENT: | 06484 | 06470 | 06801 |
| THIRD SORTATION BIN ASSIGNMENT: | 06484 | 08540 | 10022 |

SORTING METHOD AND SYSTEM WITH DYNAMICALLY RE-ALLOCATED SORTATION BINS

FIELD OF THE INVENTION

The present invention relates to media handling systems and more particularly to a sorting system and method having dynamically re-allocated sortation bins.

BACKGROUND OF THE INVENTION

Sortation systems, such as mail piece sorting equipment, are often large and complex systems having a large number of sortation bins. To sort mail for delivery by a postal service or private carrier may involve equipment having hundreds of sortation bins. This is to enable sortations that will organize the mail pieces into a delivery order sequence for the mail delivery person. The sortation process is often a multiple pass radix-type sortation algorithm process. Sortation equipment may be manufactured with a number of sortation bins to accommodate the largest number of sortation separations that may be required. In such cases, many of the sortation bins are not required for the most of the sortation applications. The equipment and the required space for the equipment can be very costly. Accordingly, it is desirable to reduce the size and cost of sorting equipment as well as to increase the equipment flexibility.

Reductions in the size of sortation equipment have utilized techniques where the size of the sortation bins are reduced by employing overflow bins. In such case, an overflow sortation bin accommodates mail being processed when the original destination sortation bin is filled. The overflow sortation bin is assigned during each sortation run as a designated overflow bin for a single original destination sortation bin. This allocation remains for the duration of the sortation run. As a result, an estimate is required before the sortation process pass commences as to which original destination sortation bins may become filled and will require during the sortation process run one or more overflow sortation bins. When this estimate is inaccurate, the sortation process may have to be stopped when an original destination sortation bin becomes filled and no overflow sortation bin has been provided. Sortation equipment of this type also does not provide flexibility for mail pieces that may have been roughly sorted prior to the commencement of a sortation run and thereby over flow different original destination sortation bins throughout the course of a sortation run.

When mail pieces are roughly grouped as mail to a given geographical area, such as Connecticut, New York and New Jersey, such mail can be combined in a sortation run. Mail pieces from each state are grouped together when loaded into the equipment for sortation run. Moreover, mail even when not roughly sorted, may be created in a way that establishes a rough grouping. If this mail is processed in a single sortation run, the sortation equipment must have a sufficient number of sortation bins to accommodate all the destinations sortation bins required for the sortation separation. Moreover, if the sortation equipment operator does not remove the mail pieces as the sortation bins approach their maximum capacity, the sortation equipment will either stop or, in a more difficult situation, jam. A jam of the sortation equipment will require operator intervention to restart the machine by clearing all of the jammed mail pieces, which also may be mutilated.

SUMMARY OF THE INVENTION

It has been discovered that a sortation system can be employed that recycles sortation bins to provide enhanced flexibility for sortation equipment. Sortation bins may be recycled as overflow bins for mail pieces directed to various different original destination sortation bins during the sortation process. The sortation bins can also be recycled to accommodate changing sortation requirements for the mail pieces being processed.

By dynamically reassigning destination sortation bins, sortation bins are reallocated for mail pieces during the sortation process. The dynamic reassignment of sortation bins during the sortation process for mail pieces to different destination sortation bins, in accordance with the present invention, provides great flexibility. It provides sortation overflow bins for mail pieces directed to original destination sortation bins and re-mapping of sortation bin allocations to accommodate changing sortation requirements and composition of the mail pieces being processed. This dynamic reassignment of sortation bins allows mail pieces to be directed to different sortation bins during the sortation process as experience is obtained with the specific mail being processed. That is, the sortation bins can be dynamically assigned to accommodate the volume of mail pieces directed to a specific sortation bin, based on the actual requirements, thereby enhancing the sortation equipment functionality.

The dynamic reassignment of mail pieces to sortation bins during the sortation run enables mail pieces to be grouped together as input for the sortation equipment even when the total number of sortation bins to properly separate the stack of mail is insufficient absent the dynamic sortation bin reassignment for the mail pieces. Displays on the sortation bins assist the machine operator with information as to the status and current assignment of a particular sortation bin.

A sorter system embodying the present invention includes a plurality of sortation bins. A feed path is connected to the plurality of sortation bins for transporting media items to destination sortation bins of the plurality of sortation bins. A controller is connected to control the plurality of sortation bins and is operable during a sortation process to reassign the destination sortation bin into which a media item is sorted.

In accordance with the present invention a method for sorting media items includes feeding a plurality of media items onto a transport system for sortation. Each media item is sorted into a destination sortation bin of a plurality of sortation bins connected to the transport system. Destination sortation bins for media items are dynamically reassigned based of the status of the media items in the sortation bins.

In accordance with an aspect of the invention, the status of media items is determined by sensors in each of said plurality of sortation bins. Alternatively the status may be virtually tracked by the controller alone or as an augmentation of the sensors.

BRIEF DESCRIPTION OF THE DRAWINGS

Reference is now made to the various figures wherein like reference numerals designate similar items in the various figures and in which:

FIG. 3 is a chart of the possible sortation bin conditions during operation of the sorter system shown in FIGS. 1 and 2;

FIG. 4 is a chart of the sortation bin conditions during the normal operation of the sorter system shown in FIGS. 1 and 2 when no equipment error conditions occur;

DETAILED DESCRIPTION OF THE PREFERRED EMBODIMENT

Figure 1:
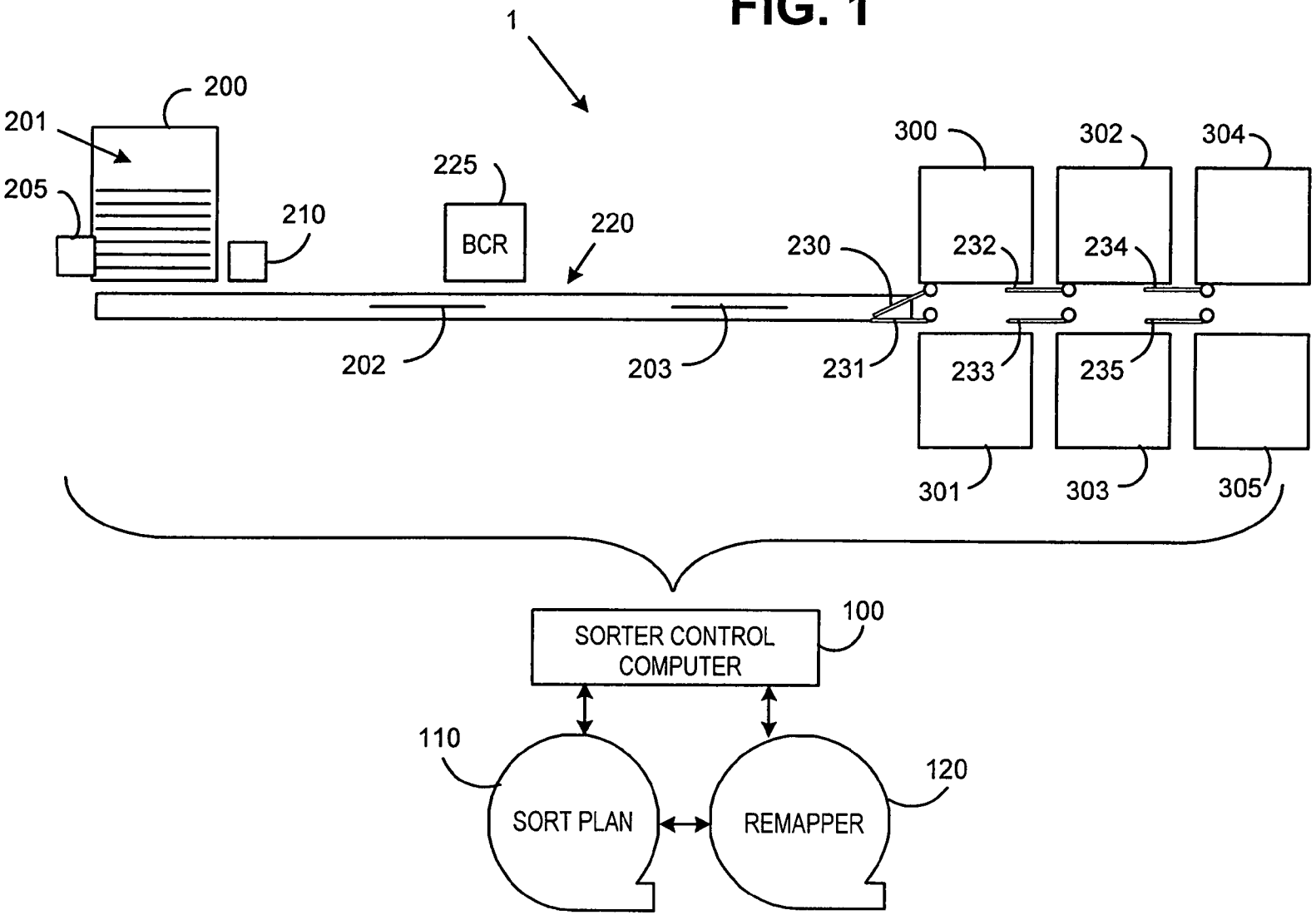
FIG. 1 is a diagrammatic view of a mail piece sorter system embodying the present invention and employing dynamically reallocated mail piece sortation bins for mail pieces being processed.

Reference is now made to FIG. 1. A mail piece sorter system 1 includes a mail piece magazine 200 containing a stack of mail pieces, shown generally at 201. A mail piece feeder 210 feeds individual mail pieces out of the magazine 200 and onto the sorter transport 220. A barcode reader (BCR) 225 mounted along the transport path reads barcodes printed on passing mail pieces, such as mail piece 202, for use by a sorter control computer 100. The sorter control computer 100 controls the operation of the sorter system and utilizes sort plan data base 110 and re-mapper data base 120. On any given radix sortation pass, the sort plan data base 110 provides a sortation bin assignment for each address or ZIP code, which is often represented by a POSTNET barcode on the mail piece. The re-mapper data base 120 is provided to re-map or dynamically reassign mail pieces in the mail piece stack 201 to different destination sortation bins from that provided by the sort plan data base 110. The re-mapper data base 120 translates the sort plan data base physical sortation bin assignment lookup (e.g. number 301) into a temporary or reassigned sortation bin number (e.g. 303) when the original sortation bin is not available for use.

Therefore, the sort plan data base 110 can be prepopulated with the desired sortation patterns for each sortation pass while the re-mapper data base 120 maintains tracking of the temporary reassignments and the required relabeling of the sortation bins for operator instruction so that the intended outcome of the original sort plan is achieved regardless of the use of any temporary interim reallocation and reassignment of sortation bins to meet operational requirements.

Sortation bins 300, 301, 302, 303, 304 and 305 are connected to the transport 220. The sortation bins each have an associated bin diverter, respectively bin diverters 230, 231, 232, 233, 234 and 235. Bin diverters 231, 232, 233, 234 and 235 are shown in their closed positions. Bin diverter 230 is shown in the deployed (open) position. When deployed, such as bin diverter 230, the bin diverter will cause the mail pieces on the transport 220 to move into the associated sortation bin (e.g. 300). The sort plan data base 110 identifies the desired destination sort bin for each address and therefore for each mail piece. For example, a mail piece, such as mail piece 203, may be addressed to Shelton, Conn., having a ZIP code 06484. Based on the reading of the bar code printed on the mail piece by BCR 225, the sorter control computer 100 identifies from the sort plan data base 110 that this mail piece should be directed to bin 300 and therefore causes the bin diverter 230 to be deployed. As the mail piece 203 approaches sortation bin 300, the deployed bin diverter 230 causes the mail piece to move into bin 300. As will be explained hereinafter, the re-mapper data base 120 may dynamically reassign the sortation bin and therefore cause a different diverter to be deployed based on the condition of the sortation equipment without changing the sort plan data base 110.

Figure 2:
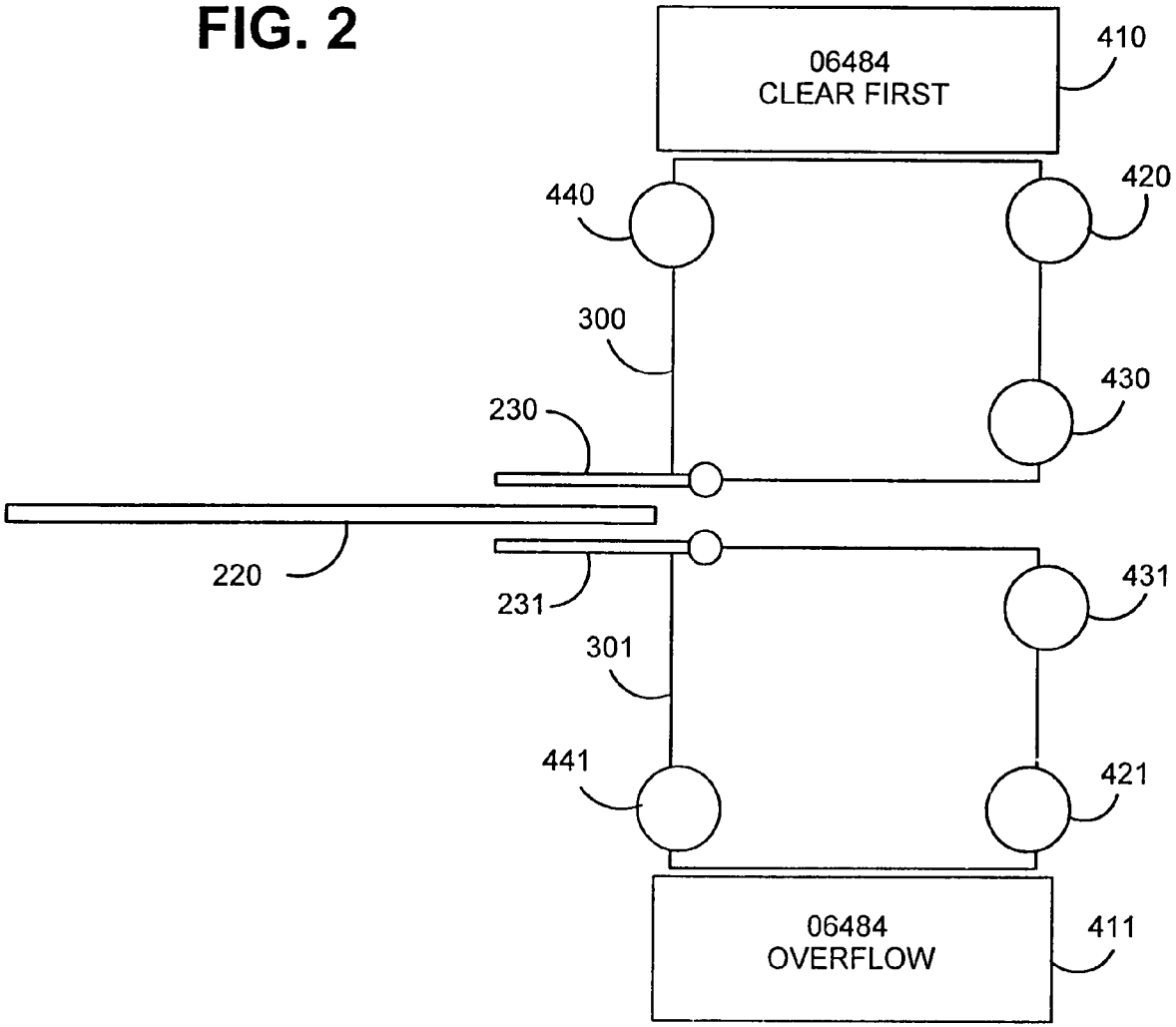
FIG. 2 is an enlarged diagrammatic view of two of the sortation bins shown in FIG. 1, with details as to features of the sortation bins.

Reference is now made to FIG. 2, showing details of sortation bins 300 and 301. Sortation bin 300 includes a status sensor 420 for bin full and a status sensor 430 for bin empty as well as a display 410 for identifying the status and the contents of the sortation bin. In the event that the sortation bin 300 becomes filled with mail pieces destined, for example, to ZIP code 06484, shown at the bin display 410, the bin full sensor 420 will detect this condition and activate the local bin full alarm 440. The bin full alarm may be a visual and/or auditory alarm for the machine operator to remove (sweep) the mail pieces from the sortation bin. Simultaneously, the bin full sensor 420 will alert the sorter control computer 100 as to the status of sortation bin 300. The sorter control computer will, through the re-mapping data base 120, assign an available sortation bin, e.g. sortation bin 301, as the overflow sortation bin for sortation bin 300. The sortation bin display 411 for bin 301 will now be updated to reflect this new assignment to read "06484 overflow" and bin display 410 for sortation bin 300 will now be updated to read "06484 clear first". Subsequent mail pieces destined for bin 300 in accordance with the sort plan data base 110 will now be redirected in accordance with the re-mapper data base 120. The mail pieces will now be directed to sortation bin 301.

When the machine operator has removed all mail pieces from sortation bin 300 and the bin empty sensor 420 detects this empty condition, the sort computer 100 will reset the destination sortation bin for 06484 mail pieces to sortation bin 300 and update the display 410 at sortation bin 300, as for example, "06484 after 301". This reflects that the mail pieces in sortation bin 300 are later in sequence than the overflow mail pieces in sortation bin 301, which is now updated to read "06484 clear first." This assists the operator to maintain the proper sequence for the mail pieces in order to implement a multipass radix-type mail piece sortation. When the machine operator has removed all mail from sortation bin 301 and the bin empty 431 detects this empty condition, the sort computer 100 will update the display 411 at sortation bin 301 as "unused." This will visually indicate to the operator that sortation bin 301 is currently unassigned and is available for reallocation as needed. The display 410 at sortation bin 300 may now be restored to the default label "06484". Should another sortation bin, e.g., 302 for ZIP code 06801, subsequently become full, the sortation bin 301 may be dynamically reallocated or reassigned during the sortation run for overflow mail pieces from the sortation bin and relabeled accordingly on the sortation bin display. It should be recognized that the description of dynamic reassignment of sortation bins to accommodate overflow of mail pieces is an example of how the dynamic reassignment of sortation bins and sortation bin displays may be utilized. The specific reassignment and display labeling will depend on the type of mail piece being processed and the type of sortation being implemented.

Some of the sortation bin instrumentation illustrated in FIG. 2 may be augmented or substituted with virtual sensors in the controller computer 100 in which case the number of mail pieces and their thickness (based upon a mail run data file or other prior knowledge of the mail piece thickness) are tracked and used to compute the status of the sortation bin. As an example, prior knowledge of the sortation bin dimensions (configured during initial machine setup) combined with information from the mail run data file which reports each mail piece to have a thickness of ⅛ inch would enable the controller computer to determine that when 80 mail pieces have been directed to a particular bin, that will cause the 10 inch bin to become full. The computer may be programmed with a margin of error to ensure that bins are not overloaded and therefore indicate a bin full condition when 70 pieces have been directed to a sortation bin. Likewise, a push button may be placed at each bin, which the operator can press when they have cleared the mail from that bin thereby indicating a bin empty condition. The bin full indicators may be present only on the control computer 100 display screen although often the local indicator at the bin is considered valuable in that it helps direct the sweeper to the specific bin that is full. The bin full indicators might also be incorporated into the bin displays (e.g. 410, 411) as additional visual elements such as an additional marker. Bin full might also be signaled by a convention such as flashing the display text, inverting the text and background colors, or changing the color of the display to indicate various conditions.

Reference is now made to FIG. 3. FIG. 3 is a chart setting out the various possible conditions for sortation bins 301 and 303, where bin 303 is provided as an overflow sortation bin for sortation bin 301. Each sortation bin can be in a condition where the sortation bin is empty, some mail pieces are present in the sortation bin, or the sortation bin is full. In this table, activation of a sensor is represented as "1" while an unactivated sensor is represented as "0". Machine bin status codes are defined (0 to 15) which represent all possible combinations and permutations of the full and empty sensor conditions associated with a pair of bins. For example, machine status 0 for sortation bins 301 and 303 represents the case in which neither the empty sensor nor the full sensor for either sortation bin is activated. Accordingly, some mail pieces are present in each of the sortation bins. As another example of the state summary chart, in machine bin status 5, the sortation bin 301 has its full sensor activated (denoted by a 1) and its empty bin sensor not activated (denoted by a 0). The overflow sortation bin 303 has its full sensor activated and the empty sensor not activated. In this condition, both the original sortation bin 301 and the overflow sortation bin 303 are full of mail. As another example, at machine bin status 10, both the original sortation bin 301 and the overflow sortation bin 303 are empty. In this machine bin status, the bin empty sensor for each of the sortation bins is activated and the bin full sensor for each of the sortation bins is not activated.

It should be recognized that some sensor activation combinations represent some form of malfunction, the bin full and bin empty sensors are simultaneously activated in the same bin. This is a condition that is not in accordance with normal operation of the machine. As an example, machine bin status 3 shows an error condition for sortation bin 301 where both the bin empty sensor and the bin full sensor are simultaneously activated. Since the sortation bin cannot be both full and empty, this would indicate an equipment or sensor failure. Similar types of error conditions are noted for machine bin status codes 7 and 11-15.

Reference is now made to FIG. 4. FIG. 4 is a chart of the normal operational sequence and machine bin status codes for original sortation bin 301 and overflow sortation bin 303. The machine bin status references are the same as set out in FIG. 3. At the start of a sortation run, both the original sortation bin 301 and the overflow sortation bin 303 are empty. At this time, both the bin empty sensors are activated (machine bin status code 10). As mail pieces are processed and moved into the original sortation bin 301, neither bin empty nor bin full" sensors are activated, indicating that some mail pieces are in the sortation bin 301 (machine bin status 8). When the original sortation bin 301 becomes full (machine status 9), the overflow sortation bin 303 is empty. At this time, the dynamic reassignment results in overflow mail pieces being directed, based on the re-mapper data base 120, into overflow sortation bin 303; and some mail pieces are now in sortation bin 303 while the original sortation bin 301 is full (machine bin status 1). As the alerted operator starts removing mail from the full bin 301, it becomes partly full (machine status 0) and both bin full and bin empty sensors are denoted as being inactive. Eventually, when the operator has fully removed the mail pieces from original sortation bin 301, the sortation bin 301 status is changed to bin empty (machine bin status 2). The overflow mail continues to be processed and moved into overflow sortation 303.

Once the original sortation bin 301 has been cleared and the overflow sortation bin 303 is full (machine bin status 6), the reassignment is reversed and mail pieces are again moved into the original sortation bin 301. At machine bin status 4, the overflow sortation bin 303 has been filled and the original sortation bin 301 is in use having mail pieces moved into the sortation bin. This is denoted by both the bin full sensor and bin empty sensor being inactive for sortation bin 301. It should be noted, however, that the reassignment of mail pieces to the original sortation bin 301 can occur whenever the original sortation bin 301 is empty and is available for use even though the overflow sortation bin 303 is not full (machine bin status 2).

If the operator had not cleared mail from the original bin 301 and mail continued to flow to sortation bin 303 then both the original sortation bin 301 and the overflow sortation bin 303 would become full (machine bin status 5). The sorter system would need to be stopped so that the operator could sweep the mail from the full sortation bins.

It should be recognized at this point in the operation of the system that because of the flexibility of dynamic reassignment of sortation bins, another unused sortation bin, as for example sortation bin 304 or 305, as shown in FIG. 1, can be dynamically reassigned to be the overflow sortation bin for original sortation bin 301. This would avoid the need to shut down the equipment to clear the full sortation bins 301 and 303. With the dynamic reassignment of overflow sortation bins, there is no need to stop the equipment until all the available bins in the entire sorter system are full.

As can be seen from the above, the ability to dynamically reassign sortation bins during the sortation run enables the sorting system to continuously operate, even though various sortation bins have been filled. The ability to loop back and repeat the process and to also utilize other sortation bins, such as sortation bins 304 and 305, provides flexibility in the sortation of mail pieces.

Figure 5:
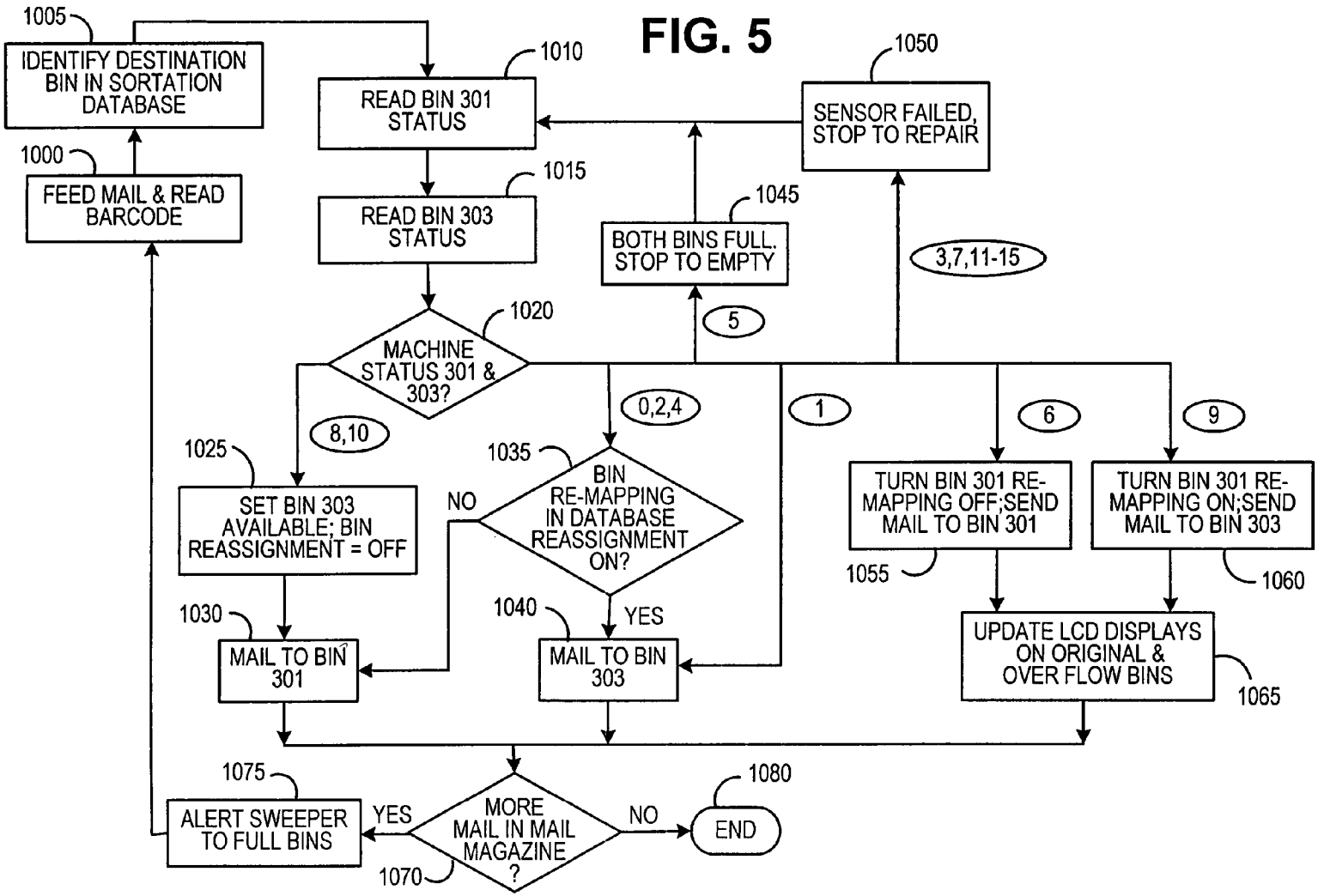
FIG. 5 is a flowchart of the operation of the sorter system shown in FIGS. 1 and 2 in which mail pieces destined to original destination sortation bins are dynamically reassigned to accommodate sortation bin overflow.

Reference is now made to FIG. 5, showing the operation of the sorter system of FIGS. 1 and 2. The balloon portions on the flow chart arrows indicate the machine bin status, which will result in the particular branching of the program as shown in the figure.

At 1000, a mail piece is fed and the bar code on the mail piece read by the sorter system. At 1005, the mail piece destination sortation bin for that ZIP code bar code is looked up in the sort plan data base 110 and identified. At 1010, the status sensors (421 and 431) of bin 301 are read to determine the operational condition of the sortation bin 301. At 1015, the status sensors of bin 303 are read. A determination is made at 1020, based on the machine status of bins 301 and 303, as to the next step in continued operation of the equipment.

If at decision block 1020, the machine status is 0, 2 or 4, the operation progresses to decision block 1035. At this point, a determination is made whether the destination sortation bin 301 is remapped in the re-mapper data base 120 which redirects mail pieces to an overflow sortation bin. If so, the mail pieces are directed to the overflow bin 303 at 1040. If not, the mail pieces are directed to the original sortation bin 301 at 1030.

If at decision block 1020, the machine status is 1, the mail pieces are directed (sort plan data base 110 lookup modified by re-mapper data base 120) to overflow sortation bin 303 at 1040. When the machine status is 6 at 1020, the system clears (turns off) the re-mapping or bin reassignment in the re-mapping data base 120 at 1055 and directs the mail pieces to original sortation bin 301. The displays are updated at 1065 on both the original and overflow sortation bins 301 and 303. Where the machine status is 9 at decision block 1020, the bin remap status in the re-mapping data base 120 is turned on at 1060 and the next available overflow sortation bin (e.g. bin 303) is assigned in the re-mapping translation data base. The mail pieces are directed to overflow sortation bin 303. Again, at 1065, the displays are updated on both the original and overflow bins 301 and 303.

The process continues with a determination being made at 1070 if more mail (sensor 205) is in the mail piece magazine 200. Where more mail is present in mail piece magazine 200, the process loops back to 1000 and continues. At 1075, an alert is activated for the operator to sweep any full sortation bins so to allow the machine to continue to operate. Where no further mail (sensor 205) is determined to be in the feeder at decision block 1070, the sortation process is ended at 1080.

If the machine status is 3, 7, or 11-15 at decision block 1020, there is a machine or sensor failure. This requires the sorter system to be stopped the error condition corrected. The process loops around back to block 1010 until the condition is corrected.

Where the machine status is 5 at 1020, meaning both sortation bins 301 and 303 are full, the system is stopped at 1045 to enable the operator to sweep the full bins. It should be noted that while the description involves only sortation bins 301 and 303, as previously noted, other unused sortation bins can be dynamically reassigned for the purpose of handling overflow mail and those additional sortation bins can allow the equipment to continue to operate when dynamically reassigned to be an overflow sortation bin for original sortation bin 301. In such instances, the machine status code would be computed, for example, based upon the original and current active bins for a particular ZIP code. Alternatively, additional overflow bins could be added to FIG. 3 and the additional machine bin status code cases could be encoded in the decision process at step 1020.

Figure 6:
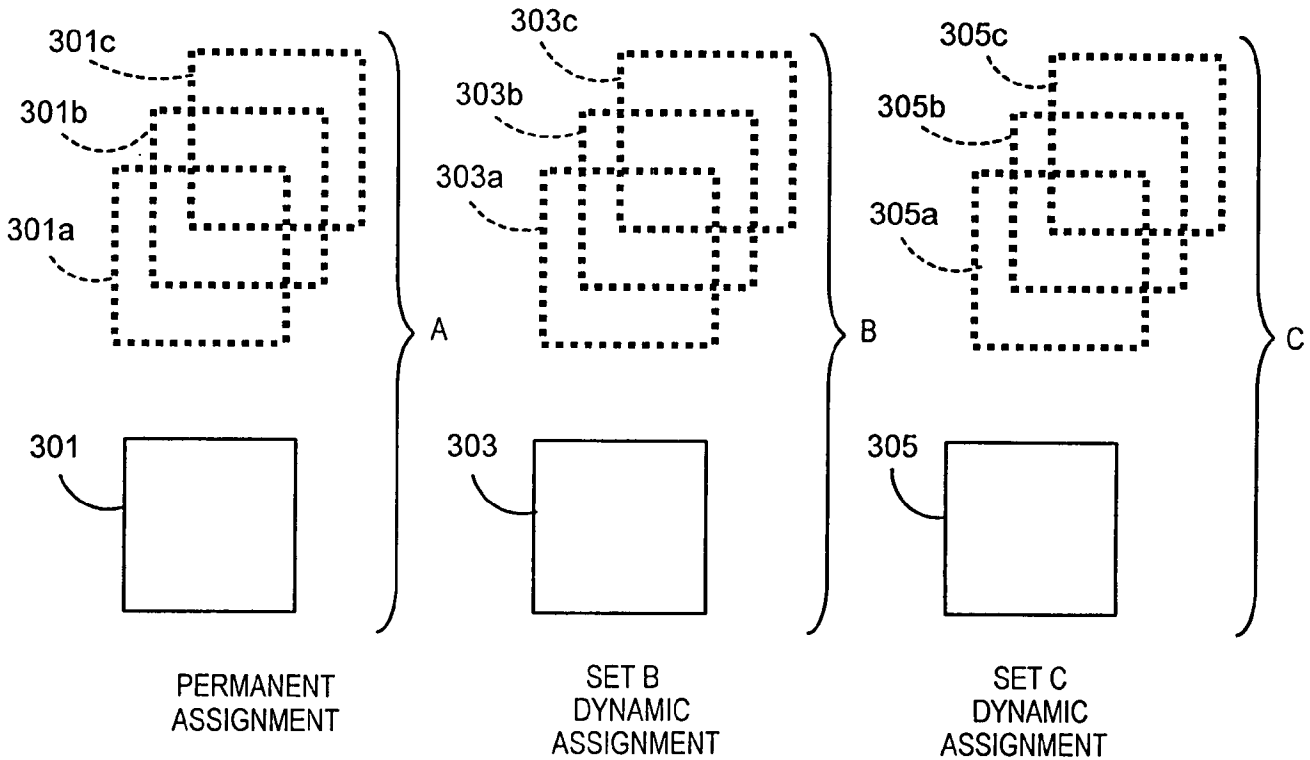
FIG. 6 is a diagrammatic view of three of the sortation bins shown in FIG. 1, with an associated chart, illustrating an example of reassignment of mail piece destination sortation bins; and, FIG. 7 is a flowchart of the operation of the system shown in FIGS. 1 and 2 in which mail piece destination sortation bins are dynamically reassigned as the sortation run progresses to accommodate sortation requirements.

Reference is now made to FIG. 6. FIG. 6 is a diagrammatic view of several sortation bins demonstrating their dynamic utilization during a sortation run, as shown in the associated chart. Sortation bin 301 and all of the other sortation bins 301*a*, 301*b* and 301*c* in bank A are permanently assigned to a particular sortation separation functionality. Mail pieces bearing ZIP code 06484 are always destined to bin 301 in this sortation plan as shown in the associated chart. Likewise other ZIP codes can be permanently assigned to the other bins in bank A (301*a*, 301*b*, 301*c*).

In contrast, banks B and C of sortation bins are dynamically reassigned for mail pieces with different ZIP codes during the sortation run. With respect to sortation bin 303 and the other sortation bins 303*a*, 303*b* and 303*c* in bank B, the bin assignments for mail pieces are changed during the sortation run. As an example, as shown in the associated chart, the first sortation bin assignment for sortation bin 303 may be for mail pieces bearing ZIP codes 01451, a second sortation bin dynamic reassignment later in the sortation run is for mail pieces with a different ZIP code, that is, mail pieces bearing ZIP code 06470. Yet another sortation bin dynamic reassignment for sortation bin 303 is implemented still later in the sortation run for mail pieces bearing to ZIP code 08540. In a similar fashion, sortation bin 305 and sortation bins 305*a*, 305*b* and 305*c* in bank C are also dynamically reassigned during the sortation run. Thus, sortation bin 305 is dynamically reassigned during the sortation run from mail pieces bearing ZIP code 02108 to mail pieces bearing ZIP code bearing 06801 to mail pieces bearing ZIP code 10022.

In the above manner by dynamically reassigning sortation bins 303 and 305 during the sortation run to be the destination sortation bin for mail pieces with different delivery ZIP codes, six different ZIP codes on mail pieces can be processed with these 2 bins. The dynamic reassignment of the sortation bin is implemented after mail pieces in the bin have been removed during the sortation run by the machine operator while mail pieces are being moved into other sortation bins in the sorter system. Thus the system operation is not interrupted even though the sorter system has fewer sortation bins than the required sortation separation for various different delivery ZIP codes of the mail pieces being processed. Depending on the particular sortation application it may be desirable to first process sortation bin 303 with mail pieces bearing ZIP code 01451. While mail pieces are being removed from sortation bin 303, mail pieces bearing ZIP code 02108 are directed into sortation bin 305. In like fashion, while mail pieces are being removed from sortation bin 305, mail pieces bearing ZIP code 06470 are directed into sortation bin 303. This process may be implemented by creating sort plan data bases 110 that allocate bin numbers from 300 to 399 even though the sorter system contains only 40 physical bins. The re-map data base 120 then remaps the out of range bin numbers to bin numbers within the physical range.

Figure 7:
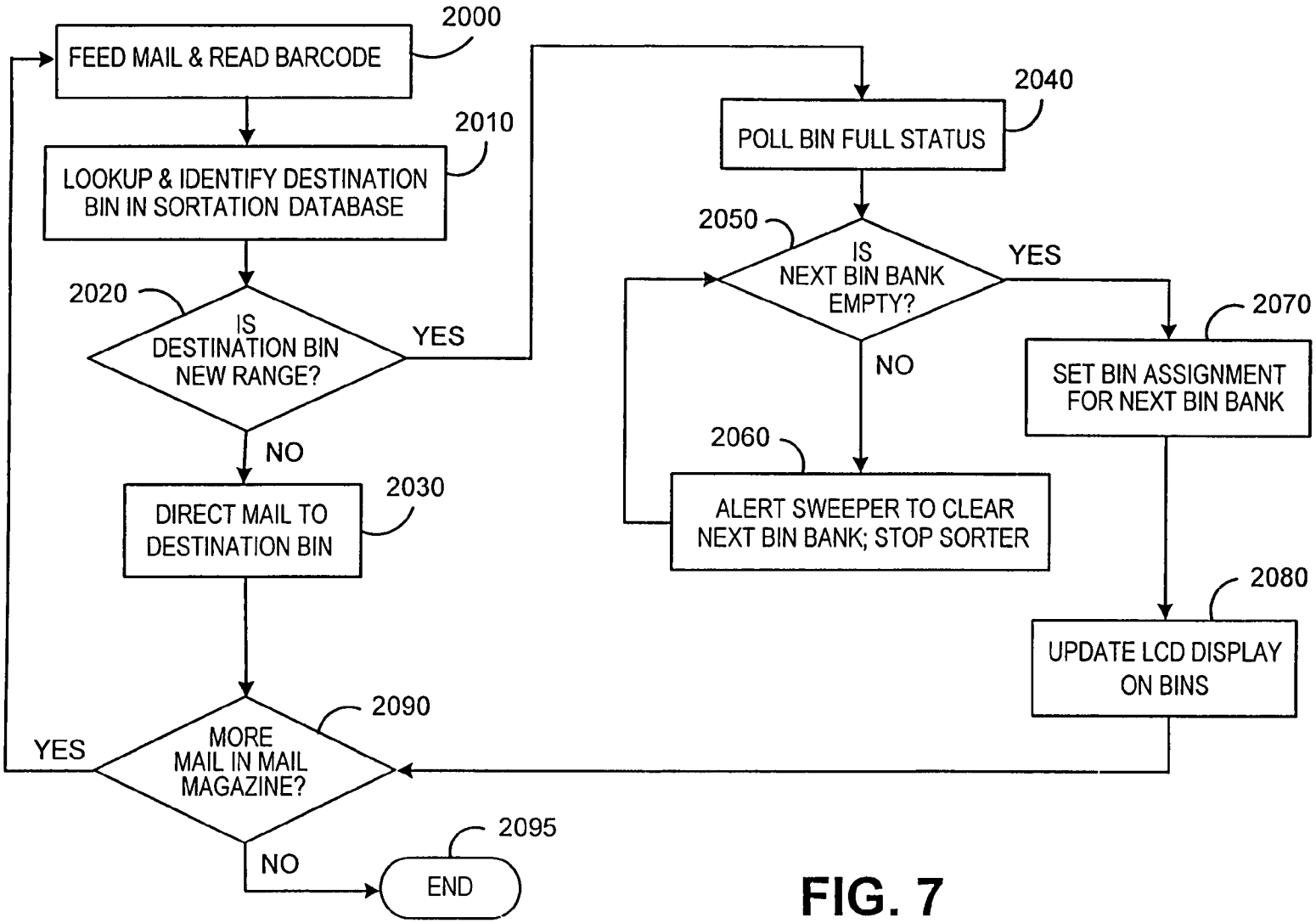

Reference is now made to FIG. 7. While FIG. 5 allows a single ZIP code destination (bin 301) to be mapped to two physical bins (301 and 303), FIG. 7 describes the mapping of three ZIP code destinations (02108, 06801, and 10022) to a single sortation bin 303 as the sortation run progresses. It should be noted that the system enables great flexibility. One destination sortation address may be mapped to multiple physical sortation bins through the sortation bin overflow functionality illustrated in FIG. 5. Alternatively, many destination sortation addresses may be sequentially mapped to a single physical bin during a sortation run as illustrated in FIG. 7. These two functionalities may be combined and coexist on a single sortation run on a sorter.

Mail is fed and the bar code on the mail piece read at 2000. The bar code is looked up and a destination sortation bin determined at 2010 from the sort plan data base 110. A decision is made at 2020 whether the destination sortation bin is a new (out of) range of ZIP codes. If this is not the case, mail is directed to the destination sortation bin at 2030. A determination is made if more mail is in the mail magazine at 2090. If mail is present in the magazine, the process loops back to block 2000. If no further mail is in the feeder, the process ends at 2095.

One embodiment of this system would be to create a sortation data base 110 that includes entries for a larger number of destination bins than physically exist in the equipment. When the sortation data base 110 identifies a destination sortation bin that is beyond the physical number existing on the sorter, the destination bin is remapped through the remapper data base 120 to accommodate the out of range bin numbers. Referring again to FIG. 7, when a determination is made at decision block 2020 that the ZIP code and destination sortation bin are out of range (beyond the physical bin numbers of the current sorter), the system branches to block 2040 and the sortation bin status is polled. A determination is made at decision block 2050 if the next sortation bin bank for the new mail piece ZIP code range is empty. If this is the case, the dynamic destination sortation bin reassignment for the mail pieces is set for the next sortation bin bank at 2070 in the re-map data base 120. The displays on the sortation bins are then updated at 2080. The process continues to decision block 2090. Where at decision block 2050 a determination is made that the next bin bank is not empty, the machine operator or sweeper is alerted at 2060 to clear the next sortation bin bank and the sorter is stopped. The process loops back to decision block 2050 until the bank has been cleared.

It should be recognized that these two processes (FIG. 5 and FIG. 7) can be combined. A single sortation system may incorporate both the overflow and the reuse features of the present invention. It should also be recognized that the various systems and methods described above in connection with the figures may be employed with any media items to be processed that are suitable for sortation. The term media item is intended herein to be a broad term and to include mail pieces such as various types of mail pieces such as letter mail, postcards and flats. The USPS considers mail pieces to be flats when the mail piece exceeds at least one of the dimensional regulations of letter-sized mail (e.g. over 11.5 inches long, over 6⅛ inches tall, or over ¼ inch thick) but does not exceed 15¾ inches by 12 inches by 1¼ inch thick. Flats include such mail as pamphlets, annual reports and the like. Other examples of media items include sheets of paper, checks, compact discs, DVD discs, books, packages of greeting cards, and any other items that can be sorted or sequenced on automated processing equipment. Accordingly, while the detailed description is directed to the processing mail pieces, any other suitable media items can be substituted for the mail pieces in the description. A sortation plan would be employed which is appropriate for the specific type of media, the particular application and the specific sortation equipment employed. Various sortation systems may be employed. These sortation systems may, for example, process mail pieces in a horizontal (lying down) or in a vertical (on edge) orientation. Mail pieces may be moved unescorted, as described above, or escorted, that is, contained within a carrier as is common on flats sorting systems because of the difficulty of handling such a wide range of materials.

While the present invention has been described in connection with what is presently considered to be the most practical and preferred embodiments, it is to be understood that the invention is not limited to the disclosed embodiment, but, on the contrary, is intended to cover various modifications and equivalent arrangements included within the spirit and scope of the appended claims.

What is claimed is:

1. A sorter system, comprising:

at least one first sortation bin;

at least one second sortation bin;

at least one third sortation bin;

a feed path for transporting a plurality of media items to the sortation bins; and a controller to control sortation of the media items to the sortation bins, wherein the at least one first sortation bin is assigned to media items having a single attribute, and wherein the at least one second sortation bin and the at least one third sortation bin are dynamically reassigned to media items having a varying attribute, different from the single attribute;

wherein each of said plurality of sortation bins includes status sensors connected to said controller, said status sensor providing data to said controller of media items in said sortation bin;

wherein each of said status sensors connected to each of said plurality of sortation bins includes a sortation bin empty sensor; and wherein each of said status sensors connected to each of said plurality of sortation bins further includes a sortation bin full sensor.

2. The sorter system of claim 1, wherein the controller determines bin status based upon prior information about the media items being processed.

3. The sorter system of claim 1, wherein said controller includes a program store containing a sort plan data base for sorting said mail pieces into destination sortation bins and a program store containing a re-mapper data base for dynamically reassigning destination sortation bins for said mail pieces based on data from said status sensor connected to each of said plurality of sortation bins.

4. The sorter system of claim 1, wherein the attribute is associated with a mailing destination of the media items.

5. The sorter system of claim 4, wherein the attribute is at least a portion of a mailing address of the media items.

6. The sorter system of claim 5, wherein the attribute is a ZIP code.

7. The sorter system of claim 1, wherein the at least one first sortation bin, the at least one second sortation bin, and the at least one third sortation bin each comprise a plurality of sortation bins.

* * * * *